US006749954B2

(12) United States Patent
Toyooka et al.

(10) Patent No.: US 6,749,954 B2
(45) Date of Patent: Jun. 15, 2004

(54) WELDED STEEL PIPE HAVING EXCELLENT HYDROFORMABILITY AND METHOD FOR MAKING THE SAME

(75) Inventors: Takaaki Toyooka, Handa (JP); Masatoshi Aratani, Handa (JP); Yoshikazu Kawabata, Handa (JP); Yuji Hashimoto, Handa (JP); Akira Yorifuji, Handa (JP); Takatoshi Okabe, Handa (JP); Takuya Nagahama, Handa (JP); Mitsuo Kimura, Handa (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/161,407

(22) Filed: May 31, 2002

(65) Prior Publication Data

US 2003/0008171 A1 Jan. 9, 2003

(30) Foreign Application Priority Data

May 31, 2001 (JP) ..... 2001-163864

(51) Int. Cl.[7] ..... B32B 15/18; C21D 9/14

(52) U.S. Cl. ..... 428/683; 138/171; 148/516; 148/519; 148/529; 148/590

(58) Field of Search ..... 428/683; 148/516, 148/519, 529, 590; 138/171

(56) References Cited

U.S. PATENT DOCUMENTS 6,006,789 A * 12/1999 Toyooka et al. ..... 138/171

FOREIGN PATENT DOCUMENTS

| | | | | |
|---|---|---|---|---|
| EP | 0 924 312 A | | 6/1999 | |
| EP | 0 940 476 A | | 9/1999 | |
| EP | 0940476 A1 | * | 9/1999 | ..... C22C/38/00 |
| JP | 11 172376 A | | 6/1999 | |

* cited by examiner

*Primary Examiner*—Robert R. Koehler
(74) *Attorney, Agent, or Firm*—Piper Rudnick LLP

(57) ABSTRACT

A welded steel pipe is formed by heating or soaking an untreated welded steel pipe having a steel composition containing, on the basis of mass percent: about 0.03% to about 0.2% C, about 2.0% or less of Si, not less than about 1.0% to about 1.5% Mn, about 0.1% or less of P, about 0.01% or less of S, about 1.0% or less of Cr, about 0.1% or less of Al, about 0.1% or less of Nb, about 0.1% or less of Ti, about 0.1% or less of V, and about 0.01% or less of N; and by reduction-rolling the treated steel pipe at a cumulative reduction rate of at least about 35% and a final rolling temperature of about 500° C. to about 900° C. The welded steel pipe exhibits excellent hydroformability, i.e., has a tensile strength of at least about 590 MPa and an n×r product of at least about 0.22. The treated steel pipe is preferably reduction-rolled at a cumulative reduction rate of at least about 20% below the $Ar_3$ transformation point.

10 Claims, 2 Drawing Sheets

WELDED STEEL PIPE HAVING EXCELLENT HYDROFORMABILITY AND METHOD FOR MAKING THE SAME

BACKGROUND OF THE INVENTION

1. Field of the Invention

This invention relates to welded steel pipes suitable for forming structural components and underbody components of vehicles. In particular, the invention relates to enhancement of hydroformability of welded steel pipes.

2. Description of the Related Art

Hollow structural components having various cross-sectional shapes are used in vehicles. Such hollow structural components are typically produced by spot welding parts formed by press working of a steel sheet. Since hollow structural components of current vehicles must have high shock absorbability for collision impact, the steels used as the raw material must have higher mechanical strength. Unfortunately, such high-strength steels exhibit poor press formability. Thus, it is difficult to produce structural components having highly precise shapes and sizes without defects from the high-strength steels by press molding.

A method that attempts to solve such a problem is hydroforming in which the interior of a steel pipe is filled with a high-pressure liquid to deform the steel pipe into a component having a desired shape. In this method, the cross-sectional size of the steel pipe is changed by a bulging process. A component having a complicated shape can be integrally formed and the formed component exhibits high mechanical strength and rigidity. Thus, the hydroforming attracts attention as an advanced forming process.

In the hydroforming process, electrically welded pipes composed of low or middle carbon content steel sheet containing 0.10 to 0.20 mass percent carbon are often used due to high mechanical strength and low cost. Unfortunately, electrically welded pipes composed of low or middle carbon content steel have poor hydroformability; hence, the pipes cannot be sufficiently expanded.

A countermeasure to enhance the hydroformability of electric welded pipes is the use of ultra-low carbon content steel sheet containing an extremely low amount of carbon. Electrically welded pipes composed of the ultra-low carbon content steel sheet exhibit excellent hydroformability. However, crystal grains grow to cause softening of the pipe at the seam during the pipe forming process, so that the seam is intensively deformed in the bulging process, thereby impairing the high ductility of the raw material. Thus, welded pipes must have excellent mechanical properties durable for hydroforming at the seam.

OBJECTS OF THE INVENTION

An object of the invention is to provide a welded steel pipe having excellent hydroformability durable for a severe hydroforming process.

Another object of the invention is to provide a method for making the welded steel pipe.

SUMMARY OF THE INVENTION

In the invention, the welded steel pipe has a tensile strength TS of at least about 590 MPa, preferably in the range of about 590 MPa to less than about 780 MPa, and a product n×r of the n-value and the r-value of at least about 0.22 and preferably an n-value of at least about 0.15 and an r-value of at least about 1.5.

We intensively investigated compositions of welded steel pipes and methods for making the welded steel pipes to solve the above problems and discovered that a welded steel pipe that contains about 0.03 to about 0.2 mass percent carbon and that is reduction-rolled at a cumulative reduction rate of at least about 35% and a final rolling temperature of about 500 to about 900° C. has a high n×r product (product of an n-value and an r-value) and exhibits excellent hydroformability.

According to a first aspect of the invention, a welded steel pipe having excellent hydroformability has a composition comprising, on the basis of mass percent, about 0.03% to about 0.2% C; about 0.01% to about 2.0% Si; about 1.0% to about 1.5% Mn; about 0.01% to about 0.1% P; about 0.01% to about 0.01% S; about 0.01% to about 1.0% Cr; about 0.01% to about 0.1% Al; about 0.01% to about 0.1% Nb; about 0.01% to about 0.1% Ti; about 0.01% to about 0.1% V; about 0.001% to about 0.01% N; and the balance being Fe and incidental impurities, wherein the tensile strength of the welded steel pipe is at least about 590 MPa, preferably in the range of about 590 MPa to less than about 780 MPa, and the n×r product of the n-value and the r-value is at least about 0.22. Preferably, the n-value is at least about 0.15 or the r-value is at least about 1.5. Preferably, the composition further comprises at least one group of Group A and Group B, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth element.

According to a second aspect of the invention, a method for making a welded steel pipe having excellent hydroformability comprises: heating or soaking an untreated welded steel pipe having a steel composition containing, on the basis of mass percent: about 0.03% to about 0.2% C, about 2.0% or less of Si, not less than about 1.0% to about 1.5% Mn, about 0.1% or less of P, about 0.01% or less of S, about 1.0% or less of Cr, about 0.1% or less of Al, about 0.1% or less of Nb, about 0.1% or less of Ti, about 0.1% or less of V, and about 0.01% or less of N; and reduction-rolling the treated steel pipe at a cumulative reduction rate of at least about 35% and a final rolling temperature of about 500° C. to about 900° C., the welded steel pipe thereby having a tensile strength of at least about 590 MPa and an n×r product of an n-value and an r-value of at least about 0.22. Preferably, the treated steel pipe is reduction-rolled at a cumulative reduction rate of at least about 20% at a temperature below the $Ar_3$ transformation point.

Preferably, the composition further comprises at least one group of Group A and Group B, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth element.

DETAILED DESCRIPTION

Figure 1:
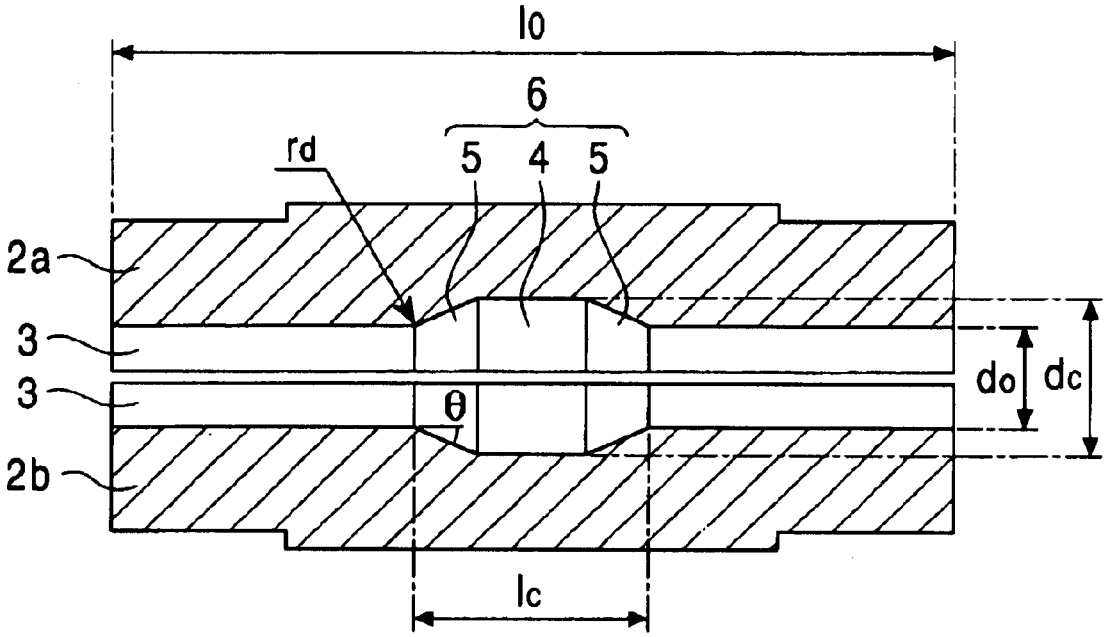
FIG. 1 is a cross-sectional view of a mold used in a free bulging test.

The reasons for the limitations in the composition of the welded steel pipe according to the invention will now be described. Hereinafter, mass percent is merely referred to as "% " in the composition.

C: about 0.03% to about 0.2%

Carbon (C) contributes to an increase in mechanical strength of the steel. At a content exceeding about 0.2%, however, the pipe exhibits poor formability. At a content of less than about 0.03%, the pipe does not have the desired tensile strength and crystal grains become larger during the welding process, thereby resulting in decreased mechanical strength and irregular deformation. Accordingly, the C content is in the range of about 0.03% to about 0.2%, preferably in the range of about 0.05% to about 0.1% to enhance formability.

Si: about 0.01% to about 2.0%

Silicon (Si) enhances the mechanical strength of the steel pipe at an amount of about 0.01% or more. However, an Si content exceeding about 2.0% causes noticeable deterioration of the surface properties, ductility, and hydroformability of the pipe. Thus, the Si content is about 2.0% or less in the invention.

Mn: about 1.0% to about 1.5%

Manganese (Mn) increases mechanical strength without deterioration of the surface properties and weldability and is added in an amount exceeding about 1.0% to ensure desired strength. On the other hand, an Mn content exceeding about 1.5% causes a decrease in the limiting bulging ratio (LBR) during hydroforming, namely, deterioration of hydroformability. Accordingly, the Mn content in the invention is in the range of not less than about 1.0% to about 1.5%, preferably about 1.0% to about 1.3%.

P: about 0.01% to about 0.1%

Phosphorus (P) contributes to increased mechanical strength at an amount of about 0.01% or more. However, a P content exceeding about 0.1% causes remarkable deterioration of weldability. Thus, the P content in the invention is about 0.1% or less. When reinforcing by P is not necessary or when high weldability is required, the P content is preferably about 0.05% or less.

S: about 0.01% or less

Sulfur (S) is present as nonmetal inclusions in the steel. The nonmetal inclusions function as nuclei for bursting of the steel pipe during hydroforming in some cases, thereby resulting in deterioration of hydroformability. Thus, it is preferable that the S content be reduced as much as possible. At an S content of about 0.01% or less, the steel pipe exhibits the desired hydroformability. Thus, the upper limit of the S content in the invention is about 0.01%. The S content is preferably about 0.005% or less and more preferably about 0.001% or less in view of further enhancement of hydroformability.

Al: about 0.01% to about 0.1%

Aluminum (Al) functions as a deoxidizing agent and inhibits coarsening of crystal grains when the Al content is about 0.01% or more. However, at an Al content exceeding about 0.1%, large amounts of oxide inclusions are present, thereby decreasing the cleanness of the steel composition. Accordingly, the Al content is about 0.1% or less in the invention. The Al content is preferably about 0.05% or less to reduce nuclei of cracking during hydroforming.

N: about 0.001% to about 0.01%

Nitrogen (N) reacts with Al and contributes to the formation of fine crystal grains when the N content is about 0.001% or more. However, an N content exceeding about 0.01% causes deterioration of ductility. Thus, the N content is about 0.01% or less in the invention.

Cr: about 0.01% to about 1.0%

Chromium (Cr) increases mechanical strength and enhances corrosion resistances at a content of about 0.01% or more. However, a Cr content exceeding about 1.0% causes deterioration of ductility and weldability. Accordingly, the Cr content in the invention is about 1.0% or less.

Nb: about 0.01% to about 0.1%

A small amount of niobium (Nb) contributes to the formation of fine crystal grains and increased mechanical strength. These effects are noticeable at an Nb content of about 0.01% or more. However, an Nb content exceeding about 0.1% causes increased hot deformation resistance, resulting in deterioration of processability and ductility. Thus, the Nb content is about 0.1% or less in the invention.

Ti: about 0.01% to about 0.1%

Titanium (Ti) also contributes to the formation of fine crystal grains and increased mechanical strength. These effects are noticeable at a Ti content of about 0.01% or more. However, a Ti content exceeding about 0.1% causes increased hot deformation resistance, resulting in deterioration of processability and ductility. Thus, the Ti content is about 0.1% or less in the invention.

V: about 0.01% to about 0.1%

Vanadium (V) also contributes to the formation of fine crystal grains and increased mechanical strength. These effects are noticeable at a V content of about 0.01% or more. However, a V content exceeding about 0.1% causes increased hot deformation resistance, resulting in deterioration of processability and ductility. Thus, the V content is about 0.1% or less in the invention.

In the invention, the composition may further comprise at least one group of Group A and Group B, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth element.

Reasons for Limitations of Contents of Group A Elements

Cupper (Cu), nickel (Ni), molybdenum (Mo), and boron (B) increase mechanical strength while maintaining ductility. These elements may be added, if desired. For increased mechanical strength, Cu, Ni, or Mo should be added in an amount of about 0.1% or more or B should be added in an amount of about 0.001% or more. On the other hand, the effects of these elements are saturated at a Cu, Ni, or Mo content exceeding about 1.0% or a B content exceeding about 0.01%. Furthermore, a steel pipe containing excess amounts of these elements exhibits poor hot and cold workability. Thus, the maximum contents of these elements are preferably about 1.0% for Cu, about 1.0% for Ni, about 1.0% for Mo, and about 0.01% for B.

Reasons for Limitations of Contents of Group B Elements

Calcium (Ca) and rare earth elements facilitate the formation of spherical nonmetal inclusions, which contribute to excellent hydroformability. These elements may be added, if desired. Excellent hydroformability is noticeable when about 0.002% or more of Ca or rare earth element is added. However, at a content exceeding about 0.02%, excess amounts of inclusions are formed, thereby resulting in decreased cleanness of the steel composition. Thus, the maximum content for Ca and rare earth elements is preferably about 0.02%. When both Ca and a rare earth element are used in combination, the total amount is preferably about 0.03% or less.

The balance other than the above-mentioned components is iron (Fe) and incidental impurities.

The welded steel pipe having the above composition according to the invention has a tensile strength TS of at least about 590 MPa, preferably in the range of about 590 MPa to less than about 780 MPa, and a product n×r of at least about 0.22. These values show that this welded steel pipe is suitable for bulging processes. At a product n×r of less than about 0.22, the welded steel pipe has poor bulging formability. Preferably, the n-value is at least about 0.15 for achieving uniform deformation. Furthermore, the r-value is preferably at least about 1.5 for suppressing local wall thinning.

Furthermore, the welded steel pipe according to the invention preferably exhibits a limiting bulging ratio (LBR) of at least about 40%. The LBR is defined by the equation:

$$LBR\ (\%)=(d_{max}-d_0)/d_0\times 100$$

wherein $d_{max}$ is the maximum outer diameter (mm) of the pipe at burst (break) and $d_0$ is the outer diameter of the pipe before the test.

In the invention, the LBR is measured by a free bulging test with axial compression.

Figure 2:
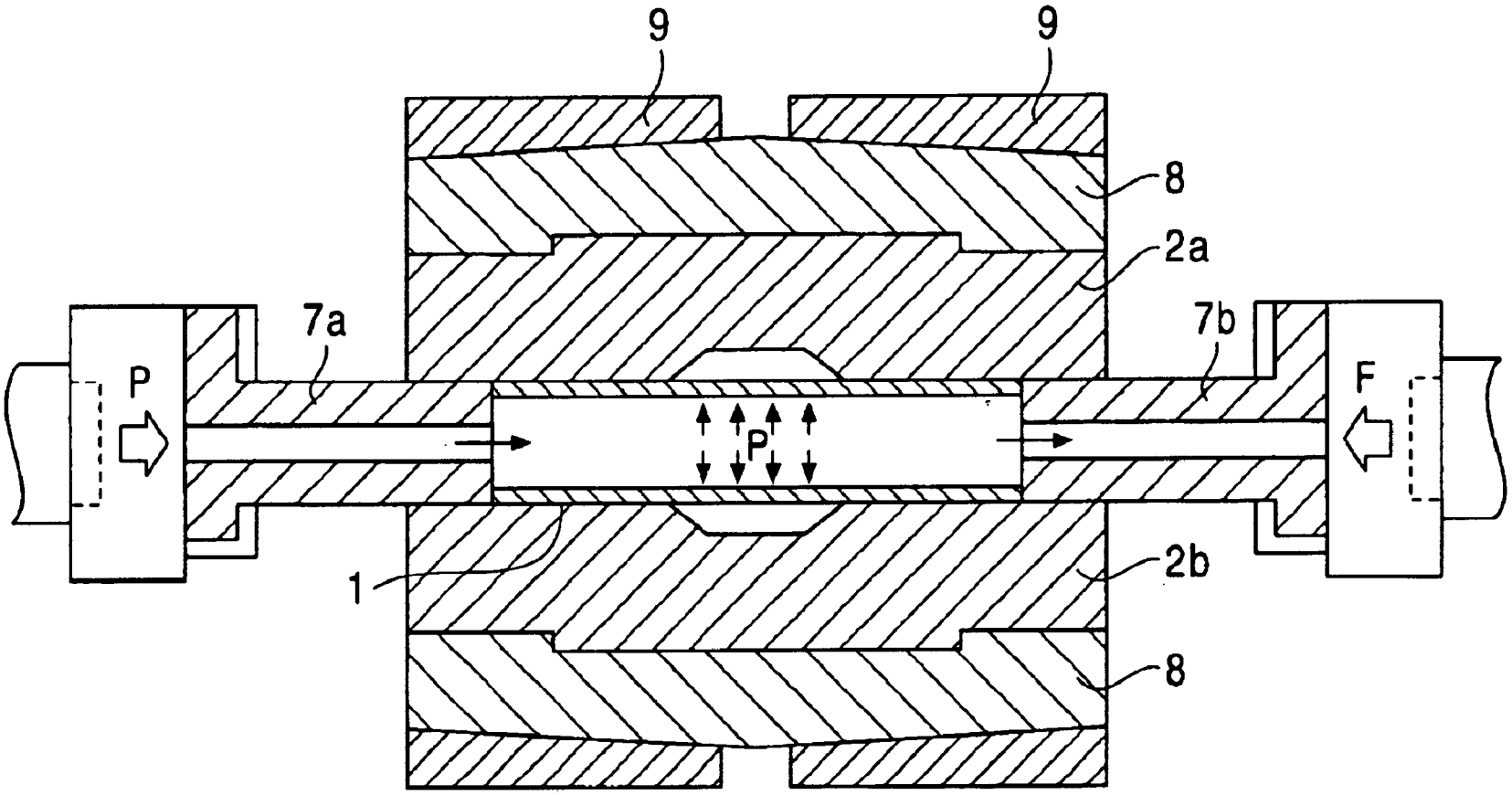
FIG. 2 is a cross-sectional view of a hydroforming apparatus used in the free bulging test.

The free bulging test may be performed by bulging the pipe, for example, in a hydroforming apparatus shown in FIG. 2 that uses a two-component mold shown in FIG. 1.

FIG. 1 is a cross-sectional view of the two-component mold. An upper mold component 2*a* and a lower mold component 2*b* each have a pipe holder 3 along the longitudinal direction of the pipe. Each pipe holder 3 has a hemispherical wall having a diameter that is substantially the same as the outer diameter $d_0$ of the pipe. Furthermore, each mold component has a central bulging portion 4 and taper portions 5 at both ends of the bulging portion 4. The bulging portion 4 has a hemispherical wall having a diameter $d_c$, and each taper portion has a taper angle θ of 45°. The bulging portion 4 and the taper portions 5 constitute a deformation portion 6. The length $l_c$ of the deformation portion 6 is two times the outer diameter $d_0$ of the steel pipe. The diameter $d_c$ of the hemispherical bulging portion 4 may be about two times the outer diameter $d_0$ of the steel pipe.

Referring to FIG. 2, a test steel pipe 1 is fixed with the upper mold component 2*a* and the lower mold component 2*b* so that the steel pipe 1 is surrounded by the pipe holders 3. A liquid such as water is supplied to the interior of the steel pipe 1 from an end of the steel pipe 1 through an axial push cylinder 7*a* to impart liquid pressure P to the pipe wall until the pipe bursts by free bulging in a circular cross-section. The maximum outer diameter $d_{max}$ at burst is determined by averaging the values calculated by dividing the perimeters of the bursting portions by the circular constant π.

The upper and lower mold components have respective mold holders 8 and are fixed with outer rings 9 to fix the steel pipe in the mold.

In the hydroforming process, the pipe may be fixed at both ends or a compressive force (axial compression) may be loaded from both ends of the pipe. In the invention, an appropriate compressive force is loaded from both ends of the pipe to achieve a high LBR. Referring to FIG. 2, the compressive force F in the axial direction is loaded to the axial push cylinders 7*a* and 7*b*.

A method for making the welded steel pipe according to the invention will now be described.

In the invention, the above-mentioned welded steel pipe is used as an untreated steel pipe. The method for making the untreated steel pipe is not limited. For example, strap steel is cold-, warm-, or hot-rolled or is bent to form open pipes. Both edges of each open pipe are heated to a temperature above the melting point by induction heating. The ends of the two open pipes are preferably butt-jointed with squeeze rolls or forge-welded. The strap steel may preferably be a hot-rolled steel sheet, which is formed by hot rolling a slab produced by a continuous casting process or an ingot-making/blooming process using a molten steel having the above composition, and a cold-rolled/annealed steel sheet, and a cold-rolled steel sheet.

In the method for making the welded steel pipe according to the invention, the untreated steel pipe is heated or soaked. The heating condition is not limited and preferably in the range of about 700 to about 1,100° C. to optimize the reduction rolling conditions, as described below. When the temperature of the untreated steel pipe produced by warm- or hot-rolling is still sufficiently high at the reduction rolling process, only a soaking process is required to make the temperature distribution in the pipe uniform. Heating is necessary when the temperature of the untreated steel pipe is low.

The heated or soaked steel pipe is subjected to reduction rolling using a series of tandem caliber rolling stands at a cumulative reduction rate of at least about 35%. The cumulative reduction rate is the sum of reduction rates for individual caliber rolling stands. At a cumulative reduction rate of less than about 35%, the n-value and the r-value contributing to excellent processability and hydroformability are not increased. Thus, the cumulative reduction rate must be at least about 35% in the invention. The upper limit of the cumulative reduction rate is preferably about 95% to prevent local wall thinning and ensure high productivity. More preferably, the cumulative reduction rate is in the range of about 35% to about 90%. When a higher r-value is required, the reduction rolling is performed at a high reduction rate in the ferrite zone to develop a rolling texture. Thus, the cumulative reduction rate at a temperature region below the $Ar_3$ transformation point is preferably at least about 20%.

In the reduction rolling, the final rolling temperature is in the range of about 500 to about 900° C. If the final rolling temperature is less than about 500° C. or more than about 900° C., the n-value and the r-value contributing to processability are not increased or the limiting bulging ratio LBR at the free bulging test is not increased, thereby resulting in poor hydroformability.

In the reduction rolling, a series of tandem caliber rolling stands, called a reducer, is preferably used.

In the invention, the untreated steel pipe having the above-mentioned composition is subjected to the above-mentioned reduction rolling process. As a result, the rolled steel pipe as a final product has a tensile strength TS of at least about 590 MPa, and a high n×r product, indicating significantly excellent hydroformability.

EXAMPLES

Each of steel sheets (hot-rolled steel sheets and cold-rolled annealed steel sheets) having compositions shown in Table 1 was rolled at room temperature (cold-rolled) or at a warm temperature (500° C. to 700° C.) to form open pipes. Edges of two open pipes were but-jointed by induction heating to form a welded steel pipe having an outer diameter of 146 mm and a wall thickness of 2.6 mm. Each welded steel pipe as an untreated steel pipe was subjected to reduction rolling under conditions shown in Table 2 to form a rolled steel pipe (final product).

Tensile test pieces (JIS No. 12A test pieces) in the longitudinal direction were prepared from the rolled steel pipe to measure the tensile properties (yield strength, tensile strength, and elongation), the n-value, and the r-value of the rolled steel pipe. The n-value was determined by the ratio of the difference in the true stress (σ) to the difference in the true strain (e) between 5% elongation and 10% elongation according to the equation:

$$n=(\ln \sigma_{10\%}-\ln \sigma_{5\%})/(\ln e_{10\%}-\ln e_{5\%})$$

The r-value was defined as the ratio of the true strain in the width direction to the true strain in the thickness direction of the pipe in the tensile test:

$$r=\ln(W_i/W_f)/\ln(T_i/T_f)$$

wherein $W_i$ is the initial width, $W_f$ is the final width, $T_i$ is the initial thickness, and $T_f$ is the final thickness.

Since the thickness measurement included considerable errors, the r-value was determined under an assumption that the volume of the test piece was constant using the following equation:

$$r=\ln(W_i/W_f)/\ln(L_fW_f/L_iW_i)$$

wherein $L_i$ is the initial length and $L_f$ is the final length.

In the invention, strain gauges were bonded to the tensile test piece, and the true strain was measured in the longitudinal direction and the width direction within a nominal strain in the longitudinal direction of 6% to 7% to determine the r-value and the n-value.

Each rolled steel pipe as a final product was cut into a length of 500 mm to use as a hydroforming test piece. As shown in FIG. 2, the cut pipe was loaded into the hydroforming apparatus and water was supplied from one end of the pipe to burst the pipe by circular free bulging deformation. The average $d_{max}$ of the maximum outer diameters at burst was measured to calculate the limiting bulging ratio LBR according to the following equation:

$$LBR\ (\%)=(d_{max}-d_0)/d_0\times 100$$

wherein $d_{max}$ is the maximum outer diameter (mm) of the pipe at burst (break) and $d_0$ is the outer diameter of the pipe before the test. Regarding the mold sizes shown in FIG. 1, $l_c$ was 127 mm, $d_c$ was 127 mm, $r_d$ was 5 mm, $l_o$ was 550 mm, and θ was 45° C.

The results are shown in Table 3.

The welded steel pipes according to the invention each have a tensile strength of at least about 590 MPa, a high n-value, a high r-value, and an n×r product of at least about 0.22, showing excellent processability and hydroformability. In contrast, welded steel pipes according to Comparative Examples each have a low n×r product and a low LBR, showing poor hydroformability. Thus, the welded steel pipes according to Comparative Examples are unsuitable for components that require hydroforming.

TABLE 1

| Steel | Composition (mass %) | | | | | | | | | | | | | |
|---|---|---|---|---|---|---|---|---|---|---|---|---|---|---|
| No. | C | Si | Mn | P | S | Al | N | Cr | Ti | Nb | V | Mo, Cu, Ni, B | Ca, REM | Note |
| A | 0.1 | 1.3 | 1.1 | 0.01 | 0.001 | 0.04 | 0.002 | 0.3 | 0.01 | — | — | — | — | Example |
| B | 0.08 | 0.2 | 1.4 | 0.01 | 0.003 | 0.04 | 0.003 | — | — | 0.04 | 0.04 | — | — | Example |
| C | 0.05 | 0.95 | 1.4 | 0.01 | 0.001 | 0.03 | 0.003 | 0.9 | 0.015 | — | — | — | — | Example |
| D | 0.15 | 0.15 | 1.2 | 0.01 | 0.003 | 0.04 | 0.003 | 0.3 | — | — | — | — | — | Example |
| E | 0.08 | 0.01 | 1.5 | 0.01 | 0.001 | 0.04 | 0.002 | — | 0.04 | 0.01 | — | B: 0.0010 | — | Example |
| F | 0.04 | 1.0 | 1.4 | 0.01 | 0.0008 | 0.04 | 0.002 | 0.9 | 0.01 | — | — | — | Ca: 0.0030 | Example |
| G | 0.15 | 0.15 | 1.2 | 0.01 | 0.0007 | 0.04 | 0.002 | 0.3 | — | 0.005 | — | Mo: 0.1, Ni: 0.2 | REM: 0.0030 | Example |
| H | 0.25 | 0.01 | 1.5 | 0.01 | 0.001 | 0.04 | 0.002 | — | 0.04 | — | — | — | — | Comparative Example |
| I | 0.08 | 0.01 | 0.20 | 0.01 | 0.001 | 0.04 | 0.002 | — | 0.04 | — | — | — | — | Comparative Example |
| J | 0.04 | 1.0 | 1.4 | 0.01 | 0.015 | 0.04 | 0.002 | 0.01 | 0.01 | — | — | — | — | Comparative Example |
| K | 0.02 | 1.0 | 1.4 | 0.01 | 0.003 | 0.04 | 0.003 | 0.9 | 0.01 | — | — | — | — | Comparative Example |
| L | 0.15 | 0.15 | 1.2 | 0.01 | 0.003 | 0.04 | 0.003 | 2.0 | 0.01 | 0.015 | — | — | — | Comparative Example |

TABLE 2

| | | Conditions for making | | Conditions for making Rolled Pipe | | | | |
|---|---|---|---|---|---|---|---|---|
| | | Untreated Steel Pipe | | | Reduction Rolling Conditions | | | |
| Pipe No. | Steel No. | Type of Steel Sheet | Temperature for Forming Open Pipe ° C. | Heating (Soaking) ° C. | Final Rolling Temperature ° C. | Cumulative Reduction Rate % | Cumulative Reduction Rate below $Ar_3$ Transformation Point % | $Ar_3$ Transformation Point ° C. |
| 1 | A | Hot-rolled | R.T.* | 950 | 800 | 50 | 50 | 807 |
| 2 | B | Hot-rolled | R.T. | 950 | 750 | 55 | 25 | 849 |
| 3 | C | Hot-rolled | R.T. | 1000 | 700 | 60 | 40 | 844 |
| 4 | D | Hot-rolled | R.T. | 900 | 650 | 70 | 45 | 782 |
| 5 | E | Cold-rolled | R.T. | 950 | 750 | 80 | 80 | 807 |
| 6 | F | Hot-rolled | 500 | 900 | 700 | 65 | 30 | 849 |
| 7 | G | Cold-rolled | 500 | 900 | 700 | 40 | 25 | 782 |
| 8 | H | Hot-rolled | R.T. | 950 | 750 | 60 | 50 | 763 |

TABLE 2-continued

| | | Conditions for making Untreated Steel Pipe | | Conditions for making Rolled Pipe | | | | |
|---|---|---|---|---|---|---|---|---|
| | | | | | Reduction Rolling Conditions | | | |
| Pipe No. | Steel No. | Type of Steel Sheet | Temperature for Forming Open Pipe ° C. | Heating (Soaking) ° C. | Final Rolling Temperature ° C. | Cumulative Reduction Rate % | Cumulative Reduction Rate below $Ar_3$ Transformation Point % | $Ar_3$ Transformation Point ° C. |
| 9 | I | Hot-rolled | R.T. | 950 | 750 | 60 | 50 | 846 |
| 10 | J | Hot-rolled | R.T. | 950 | 750 | 60 | 50 | 849 |
| 11 | K | Hot-rolled | R.T. | 950 | 750 | 60 | 50 | 861 |
| 12 | L | Cold-rolled | R.T. | 950 | 750 | 60 | 50 | 763 |
| 13 | A | Hot-rolled | R.T. | 950 | 700 | 30 | 10 | 807 |
| 14 | | Hot-rolled | R.T. | 950 | 700 | 30 | 20 | 807 |
| 15 | | Hot-rolled | R.T. | 950 | 400 | 50 | 25 | 807 |
| 16 | B | Hot-rolled | 500 | 950 | 950 | 50 | 50 | 849 |
| 17 | | Hot-rolled | 500 | 950 | 720 | 30 | 10 | 849 |
| 18 | | Hot-rolled | 500 | 950 | 720 | 30 | 20 | 849 |

*) R.T.: Room Temperature

TABLE 3

| | | Properties of Rolled Pipe | | | | | | | |
|---|---|---|---|---|---|---|---|---|---|
| | | Tensile Properties | | | | | | | |
| Pipe No. | Steel No. | Yield Strength YS Mpa | Tensile Strength TS Mpa | Elongation El % | n-value | r-value | n × r | Free Bulging Test Limiting Bulging Ratio LBR % | Note |
| 1 | A | 488 | 610 | 38 | 0.18 | 1.8 | 0.324 | 60 | Example |
| 2 | B | 501 | 630 | 32 | 0.18 | 1.6 | 0.288 | 55 | Example |
| 3 | C | 520 | 650 | 29 | 0.17 | 1.6 | 0.272 | 53 | Example |
| 4 | D | 602 | 750 | 27 | 0.16 | 1.6 | 0.256 | 56 | Example |
| 5 | E | 478 | 610 | 31 | 0.18 | 1.6 | 0.288 | 50 | Example |
| 6 | F | 520 | 650 | 30 | 0.17 | 1.6 | 0.272 | 53 | Example |
| 7 | G | 577 | 720 | 29 | 0.16 | 1.6 | 0.256 | 48 | Example |
| 8 | H | 624 | 780 | 15 | 0.09 | 0.9 | 0.081 | 35 | Comparative Example |
| 9 | I | 420 | 520 | 40 | 0.09 | 1.4 | 0.126 | 33 | Comparative Example |
| 10 | J | 502 | 630 | 25 | 0.09 | 1.4 | 0.126 | 36 | Comparative Example |
| 11 | K | 335 | 420 | 45 | 0.15 | 1.6 | 0.24 | 45 | Comparative Example |
| 12 | L | 624 | 780 | 15 | 0.09 | 0.8 | 0.072 | 35 | Comparative Example |
| 13 | A | 553 | 650 | 24 | 0.09 | 1.0 | 0.09 | 36 | Comparative Example |
| 14 | | 531 | 640 | 25 | 0.09 | 0.9 | 0.081 | 35 | Comparative Example |
| 15 | | 703 | 740 | 23 | 0.10 | 0.9 | 0.09 | 38 | Comparative Example |
| 16 | B | 485 | 600 | 26 | 0.11 | 1.0 | 0.11 | 39 | Comparative Example |
| 17 | | 504 | 630 | 25 | 0.09 | 0.9 | 0.081 | 37 | Comparative Example |
| 18 | | 512 | 640 | 23 | 0.09 | 0.8 | 0.072 | 36 | Comparative Example |

What is claimed is:

1. A welded steel pipe having excellent hydroformability having a composition comprising, on the basis of mass percent:

about 0.03% to about 0.2% C;

about 0.01% to about 2.0% Si;

about 1.0% to about 1.5% Mn:

about 0.01% to about 0.1% P;

about 0.01% or less of S;

about 0.01% to about 1.0% Cr;

about 0.01% to about 0.1% Al;

about 0.01% to about 0.1% Nb:

about 0.01% to about 0.1% Ti:

about 0.01% to about 0.1% V;

about 0.001% to about 0.01% N; and the balance being Fe and incidental impurities, wherein the welded steel pipe has a tensile strength of at least 590 MPa and less than 780 MPa and an n×r product of an n-value and an r-value is at least about 0.22.

2. The weld steel pipe according to claim 1, wherein the n-value is at least about 0.15 or the r-value is at least about 1.5.

3. The welded steel pipe according to claim 1, further comprising at least one group of Group A and Group B, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth element.

4. The welded steel pipe according to claim 2, further comprising at least one group of Group A and Group B, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth element.

5. A method for making a welded steel pipe having excellent hydroformability comprising:

heating or soaking an untreated welded steel pipe at about 800° C. to about 1,100° C. having a steel composition containing, on the basis of mass percent: about 0.03% to about 0.2% C.; about 2.0% or less of Si; about 1.0% to about 1.5% of Mn: about 0.1% or less of P; about 0.01% or less of S; about 1.0% or less of Cr, about 0.1% or less of Al; about 0.1% or less of Nb, about 0.1% or less of Ti, about 0.1% or less of V, and about 0.01% or less of N; and reduction-rolling the treated steel pipe at a cumulative reduction rate of at least about 35% and a final rolling temperature of about 500° C. to about 900° C., such that the welded steel pipe has a tensile strength of at least 590 MPa and less than 780 MPa and an n×r product of an n-value and an r-value of at least about 0.22.

6. The method for making a welded steel pipe according to claim 5, wherein the treated steel pipe is reduction-rolled at a cumulative reduction rate of at least about 20% at a temperature below the $Ar_3$ transformation point.

7. The method for making a welded steel pipe according to claim 5, further comprising at least one group of Group A and Group B, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth element.

8. The method for making a welded steel pipe according to claim 6, further comprising at least one group of Group A and Group B, wherein Group A includes at least one element of about 1.0% or less of Cu, about 1.0% or less of Ni, about 1.0% or less of Mo, and about 0.01% or less of B; and Group B includes at least one element of about 0.02% or less of Ca and about 0.02% or less of a rare earth element.

9. The method for making a welded steel pipe according to claim 5, wherein heating is performed at about 900° C. to about 1100° C.

10. The method for making a welded steel pipe according to claim 5, wherein the cumulative reduction rate is up to about 90%.

* * * * *